US009403265B2

(12) United States Patent
Shadwell

(10) Patent No.: US 9,403,265 B2
(45) Date of Patent: Aug. 2, 2016

(54) TOOL ADAPTER FOR INSTALLATION CLIP

(75) Inventor: Peter J. Shadwell, Longmeadow, MA (US)

(73) Assignee: Handy & Harman, White Plains, NY (US)

( * ) Notice: Subject to any disclaimer, the term of this patent is extended or adjusted under 35 U.S.C. 154(b) by 807 days.

(21) Appl. No.: 13/535,614

(22) Filed: Jun. 28, 2012

(65) Prior Publication Data

US 2014/0001228 A1 Jan. 2, 2014

(51) Int. Cl.
*B25C 7/00* (2006.01)

(52) U.S. Cl.
CPC ..... *B25C 7/00* (2013.01)

(58) Field of Classification Search
CPC ..... B25C 7/00; B25C 5/10; B25C 7/02; F16B 5/0685; H02G 3/32; G01B 5/24
USPC ..... 227/151, 220, 156, 140, 149, 8, 109, 227/107, 114, 139, 142, 120, 119, 146, 152, 227/18, 148, 123, 30, 29, 124, 113; 81/44, 81/434; 33/645, 201, 613, 666, 677, 574, 33/577, 578, 647
See application file for complete search history.

(56) References Cited

U.S. PATENT DOCUMENTS

| | | | | |
|---|---|---|---|---|
| 3,998,372 | A | 12/1976 | Leonardo et al. | |
| 5,542,323 | A | 8/1996 | Habermehl et al. | |
| 6,769,193 | B1 | 8/2004 | Meisner | |
| 2005/0040207 | A1 * | 2/2005 | Gill | 227/154 |
| 2008/0041192 | A1 * | 2/2008 | Gamble et al. | 81/44 |

OTHER PUBLICATIONS

International Search Report and Written Opinion dated Sep. 9, 2013 (PCT/US2013/046061).

* cited by examiner

*Primary Examiner* — Hemant M Desai
*Assistant Examiner* — Mary Hibbert
(74) *Attorney, Agent, or Firm* — Alix, Yale & Ristas, LLP

(57) ABSTRACT

An adapter for hands-free attachment of an installation clip to a commercially available power driving tool. The adapter has a frame and a magnetic element. The adapter is rigidly attachable to the nozzle of a power driving tool by mechanical forces, magnetic forces or a combination thereof. Once attached to the nozzle, the adapter allows attachment of an installation clip by magnetic forces generated by the magnetic element in a position for driving of an elongated securing member from the nozzle through an attachment hole in the clip. The force of the driven securing member overcomes the attractive magnetic forces and disengages the clip from the adapter.

13 Claims, 6 Drawing Sheets

TOOL ADAPTER FOR INSTALLATION CLIP

FIELD OF THE INVENTION

The invention relates to power driving tools and installation clips for use in securing deck planks to a support and/or adjacent deck planks. More particularly, the invention relates to an adapter configured for removable attachment to a power driving tool which allows an installation clip to be engaged and retained hands-free in position for attachment by driving of a securing member from the power driving tool.

BACKGROUND

Advancements have been made from the simple conventional system of deck plank installation, using fasteners driven through each plank, which have improved integrity of each plank and the deck system as a whole, as well as improving safety and efficiency.

For instance, an improved deck plank fastening system includes fasteners that attach to a side surface of the plank and a top surface of the support (i.e., a joist or like object) using securing members (i.e., nails or screws). Other improvements and permutations have been conceived in this field, including the provision of deck planks with side grooves for receiving the teeth or tabs of hidden fasteners (also referred to herein as installation clips) that can be attached directly to an underlying decking support, thereby avoiding driving a securing member through the deck plank. Such improvements have specific advantages in specific circumstances, but have not foreclosed innovation in the field.

For example, power driving devices exist and are employed which assist assembly of a decking structure by allowing installers to quickly attach fasteners to planks by driving an elongated securing member from a barrel through the fastener and into another object, such as a decking support. With many power driving devices, an installer holds the fastener in place in front of the barrel of the tool with one hand and operates the tool with his other hand to drive a securing member.

A novel nozzle retainer exists and is disclosed in co-owed and co-pending U.S. patent application Ser. No. 12/573,540. The retainer has a head protruding from the front of a barrel that is configured to engage a fastener and hold the fastener in a predetermined position in front of the barrel for substantially hands-free attachment. Examples of fasteners for which the retainer is particularly useful are disclosed in co-owned and co-pending U.S. patent application Ser. No. 13/030,625 and Ser. No. 13/532,145. The hands-free retainer substantially increases the efficiency of installation while reducing or eliminating the risk of injury to the installer.

SUMMARY

There is a need for an adapter for a variety of commercially available power driving tools having a nozzle that enables hands-free engagement/attachment of a hidden fastener in a position for a securing member to be driven from the nozzle therethrough. In one embodiment, an adapter for use with a power tool with a nozzle defining a bore from which an elongated securing member can be driven has a first surface, second surface and magnetic element. The first surface is configured to abut a distal portion of the nozzle when the adapter and nozzle are attached at least partially by mechanical forces. The second surface is configured to abut a portion of an installation clip when engaged. The magnetic element is positioned and configured to magnetically attract an installation clip toward the second surface. The adapter is shaped and configured to hold the installation clip in position with an attachment opening of the clip in registration with the nozzle bore when the adapter is attached to the nozzle and the clip is engaged with the adapter.

In another embodiment, an adapter for use with a power tool with a nozzle defining a bore from which an elongated securing member can be driven has a frame and a magnetic element. The frame has a contour configured to generally mate with a portion of the nozzle for substantially rigid attachment. The magnetic element is positioned and configured to generate magnetic forces to assist in substantially rigid attachment of the adapter to the nozzle. The magnetic forces also assist in engagement of an installation clip with the adapter.

In yet another embodiment, a method of securing an installation clip to a support is provided. A power driving tool is provided, having a nozzle defining a bore through which an elongated securing member can optionally be driven. An adapter is attached to an outer portion of the nozzle. The adapter has a frame with an inner surface, outer surface and magnetic element. The magnetic element is configured to generate magnetic forces. An installation clip is engaged with the adapter at least partially with the magnetic forces generated by the magnetic element. The clip is engaged in a position with an attachment opening which it defines aligned with the nozzle bore. The installation clip is disengaged from the adapter by driving a securing member from the nozzle bore through the attachment opening and into the support, thereby securing the clip to the support.

DESCRIPTION OF THE PREFERRED EMBODIMENT

Figure 1:
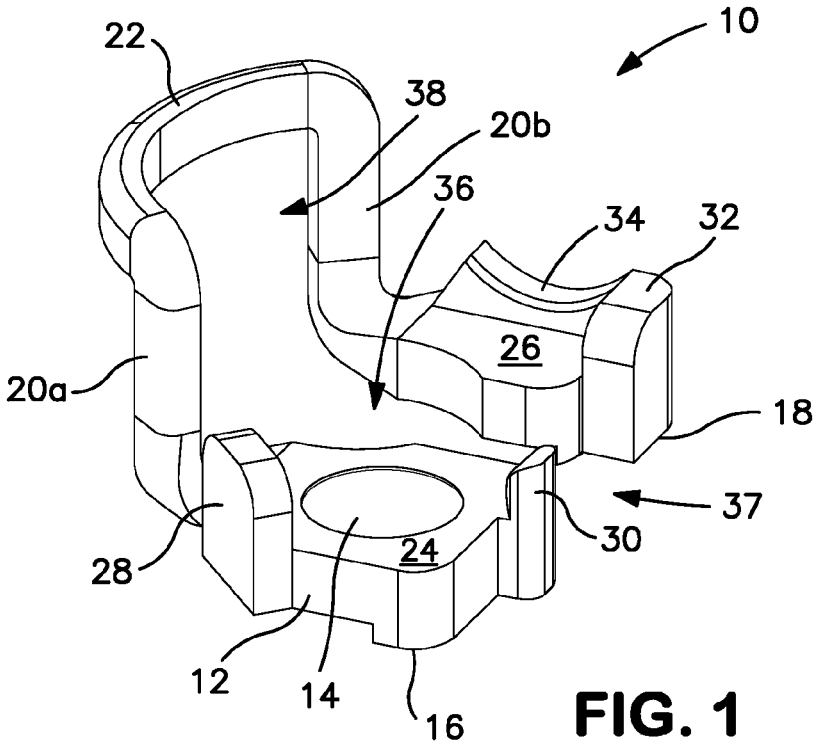
FIG. 1 shows a perspective view of a tool adapter according to the disclosure.
Figure 2:
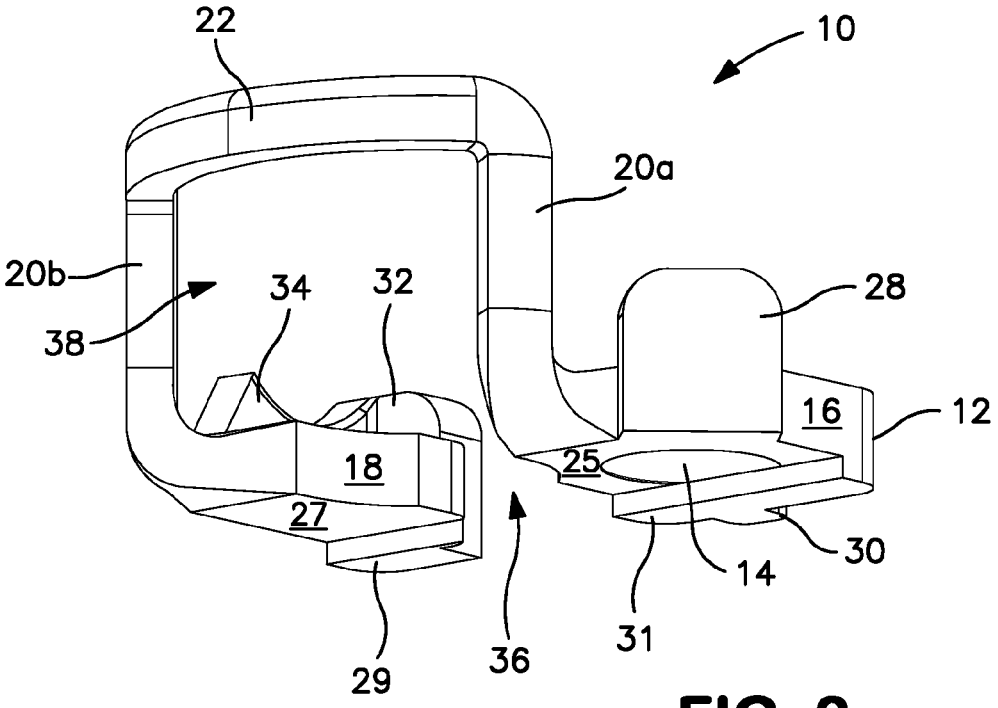
FIG. 2 shows a different perspective view of the adapter of FIG. 1.
Figure 3:
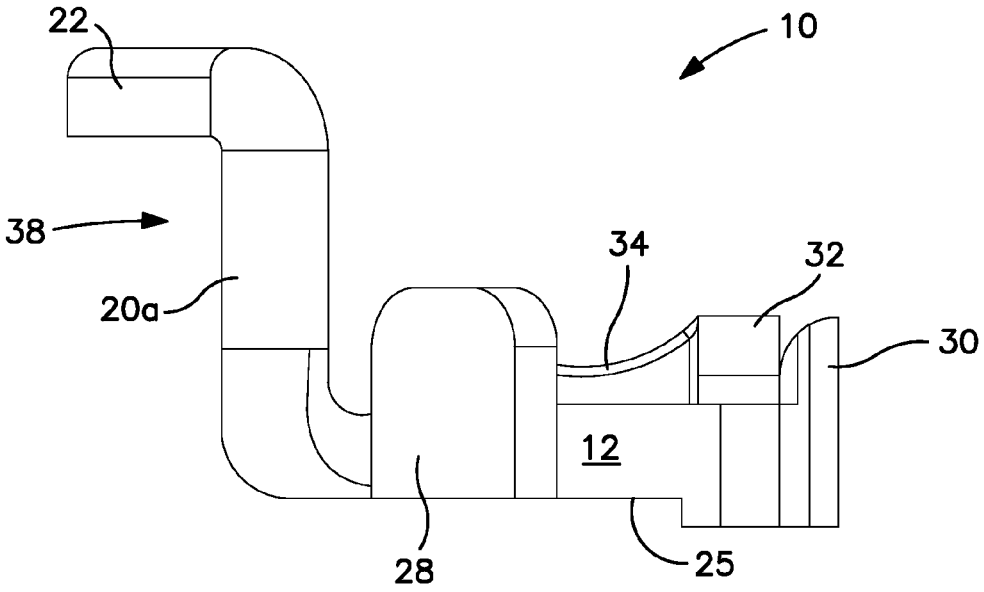
FIG. 3 is side view of the adapter depicted in FIGS. 1 and 2.
Figure 4:
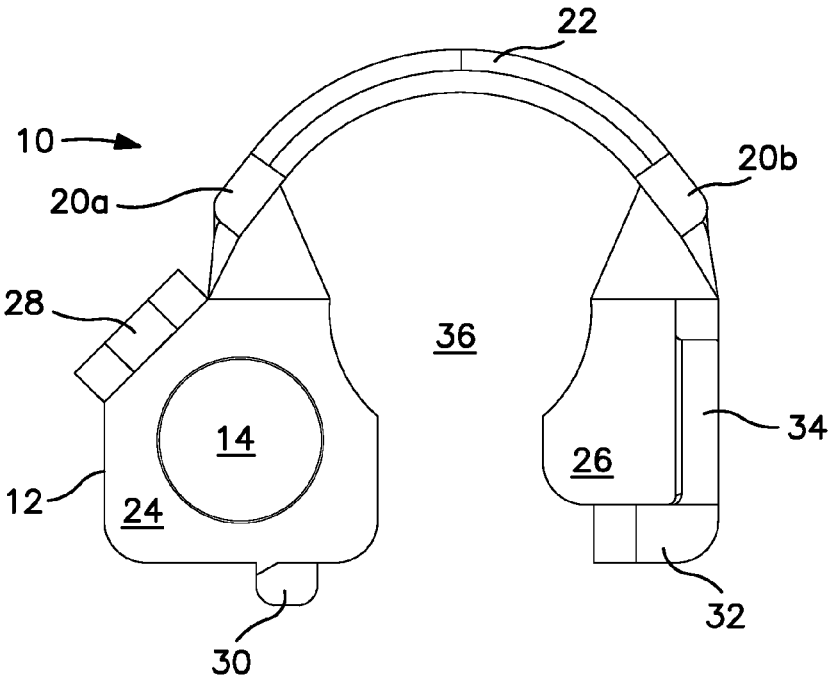
FIG. 4 is a top view of the adapter of FIGS. 1-3.

With reference to the drawings wherein like numerals represent like parts throughout the Figures, an adapter for use with a power driving tool is provided. The adapter allows a hands-free engagement of an installation clip with a power driving tool proximate the nozzle portion. The adapter is versatile in that it can be used with a variety of different power driving tools, such as nail guns. The adapter is configured to position and maintain the clip for driving of an elongated securing member from the nozzle through an attachment hole in the clip at least partially by forces generated by the adapter's magnetic element. Embodiments allow installers to convert a standard power driving tool, which often requires manual placement and holding of an installation clip in front of the nozzle, into a hands-free attachment tool. A specialized nozzle or retainer is not required to maintain the clip in an attachment position. The adapter allows attachment of individual adjacent decking planks with installation clips currently available in the marketplace in a single driving step that is significantly more efficient and safer than known devices and methods which often require manual holding of the clip in attachment position in front of the power tool.

Referring first to FIGS. 1-4, a power driving tool adapter 10 is disclosed. As shown, the adapter includes a frame 12 and a magnetic element 14. In this embodiment, the frame 12 is split into a left portion 16 and right portion 18 with an arm 20 extending therebetween. Here, the arm 20 defines a left segment 20*a* extending from the left frame portion 16, which transitions via the bridge 22 to the right segment 20*b* that extends from the right frame portion 18. Here, the left and right segments 20*a* and 20*b* extend from their respective frame portion generally parallel to each other and are substantially symmetrical. The exact configuration of the arms can be altered as appropriate for use with different nozzles. The bridge 22 is preferably sized and shaped to mate with the outer surface of a nozzle of a power driving tool. A preferred embodiment exists wherein the frame is made from a substantially rigid polymeric material. As shown in the Figures, the left portion 16 and right portion 18 define the bottom opening 36 and rear opening 37. Similarly, left arm segment 20*a*, bridge 22 and right arm segment 20*b* define the front opening 38. As can be seen, the front opening 38 transitions to the rear opening 37 via the bottom opening 36. The shape and configuration of the frame 12 and defined openings are configured to mate with a nozzle, while leaving the nozzle opening substantially unobstructed when attached.

As can be seen in FIGS. 1-4, the left portion 16 and right portion 18 respectively define upper (inner) surfaces, 24 and 26, that are substantially flat and coplanar. The upper surfaces are configured to preferably mate a distal end of a power driving tool nozzle. Similarly, the respective frame portions define a left bottom (outer) surface 25 and right bottom (outer) surface 27, configured to abut an installation clip when the clip and adapter are engaged. Each frame portion, 16 and 18, includes a rear ridge (depicted as reference numerals 29 and 31) extending therefrom in the direction of the bottom surfaces. The rear ridges in the depicted embodiment extend substantially perpendicular to the bottom surface, however this exact angular relationship is not limiting. The left portion 16 includes a left side flange 28 extending generally perpendicular to the upper surface, and parallel and in the direction of the arm segments 20*a* and 20*b*. Extending substantially parallel to and in the direction of the left side flange 28 is the left rear flange 30. The left side flange 28 and left rear flange 30 are positioned to assist in aligning and attaching the adapter 10 to the nozzle of the tool, as will be discussed in greater detail below.

The right portion 18 is fit with a rear flange 32, which transitions around an approximately 90° corner into the right side flange 34. The right rear and side flanges extend generally perpendicular to the upper surfaces. Here, the right side flange 34 is shaped with a concavity for mating with the nozzle when the adapter 10 is attached thereto.

Figure 5A:
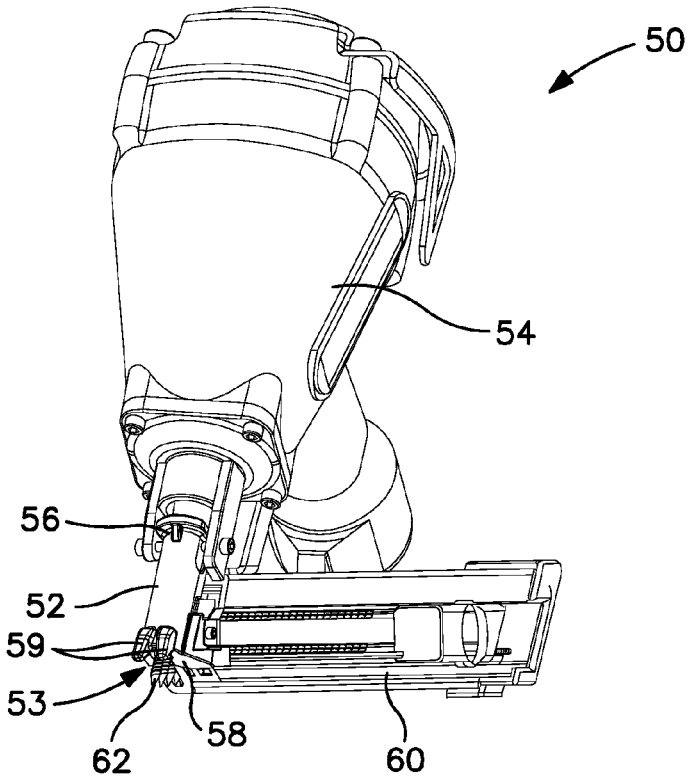
FIG. 5A shows a representative power tool with which the disclosed adapter is configured for use.

This embodiment of the adapter 10 is configured for use with a conventional power driving tool, such as the pneumatic nail gun depicted as reference numeral 50 in FIG. 5A. The tool 50 has a barrel 52 extending from a body 54, from a barrel proximal end 56 to a distal end 58 defining a surface. The barrel 52 of such tools defines a bore 53 and is typically made of steel or a similar metal that is magnetically attractive. Extending forward from and past the distal end 58 are two alignment extensions 59. Operatively engaged with the barrel 52 is a magazine clip 60 (here, a slide-and-spring-type) which houses a plurality of elongated securing members, like those depicted as reference numeral 62. The magazine clip 60 automatically advances a front most securing member 62 into the bore 53 in position to be driven. The tool depicted is simply an example of a known commercially available tool with which the disclosed adapter 10 is configured for use. Essentially, the disclosed adapter 10 can be configured for use with any tool that drives elongated securing members from the opening of an elongate nozzle or barrel.

Figure 5B:
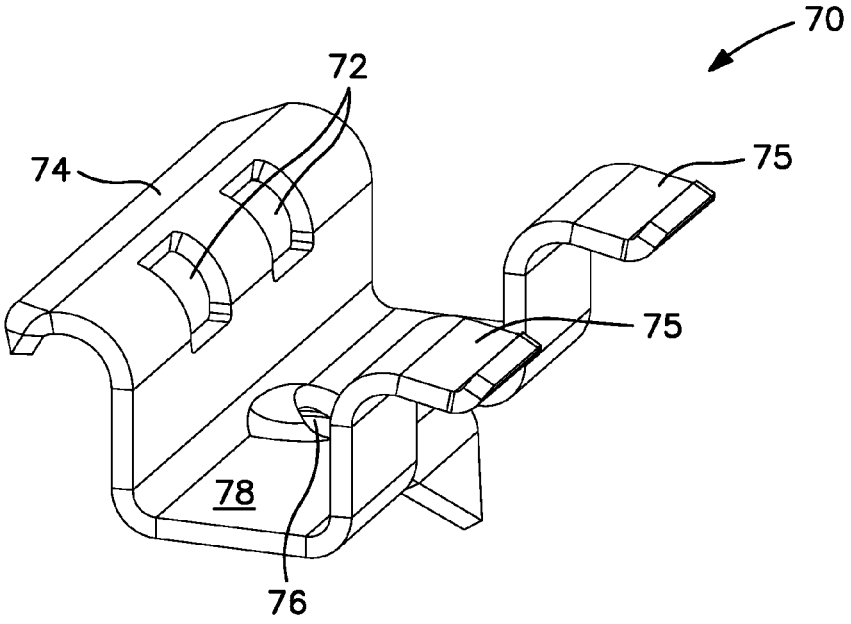
FIG. 5B shows a representative installation clip with which the disclosed adapter is configured for use.

FIG. 5B depicts an example of an installation clip 70 for which the disclosed adapter 10 is configured for use. As shown, the body of the clip 70 defines a pair of alignment holes 72 proximate the front wing 74 and an attachment hole 76 through the body 78. Trailing feet 75 extend opposite the front wing 74. Additional commercially available installation clips can be installed using the disclosed adapter 10.

Figure 6:
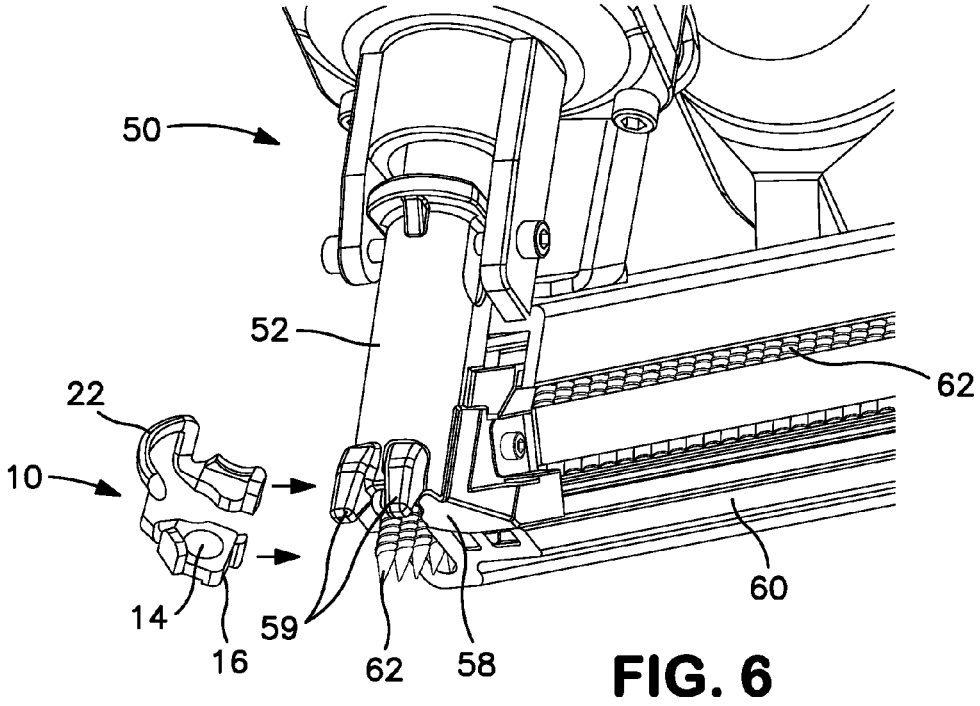
FIG. 6 shows an enlarged view of the nozzle portion of the power tool of FIG. 5A prior to attachment of the adapter of FIGS. 1-4.
Figure 7:
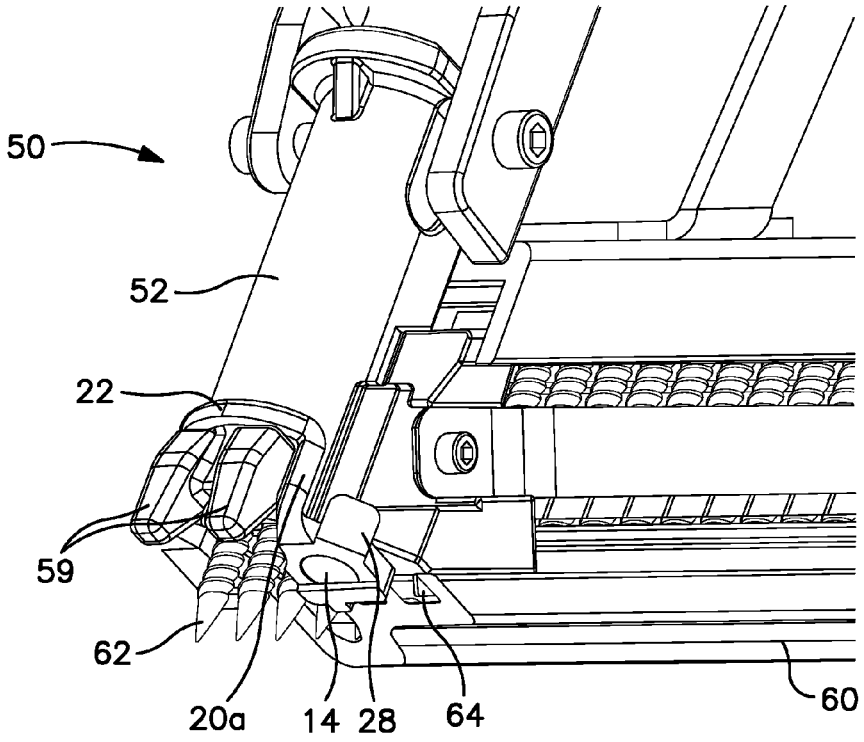
FIG. 7 shows an enlarged view of the disclosed adapter attached to the nozzle portion of the previously depicted power tool.
Figure 8A:
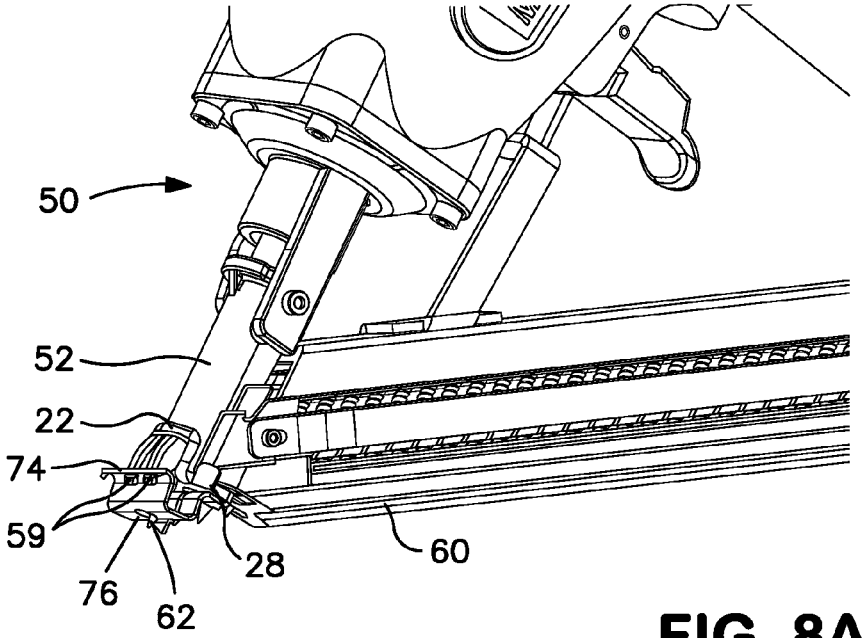
FIG. 8A is a side elevation view of the disclosed adapter attached to the power tool and engaged with the installation clip of FIG. 5B.
Figure 8B:
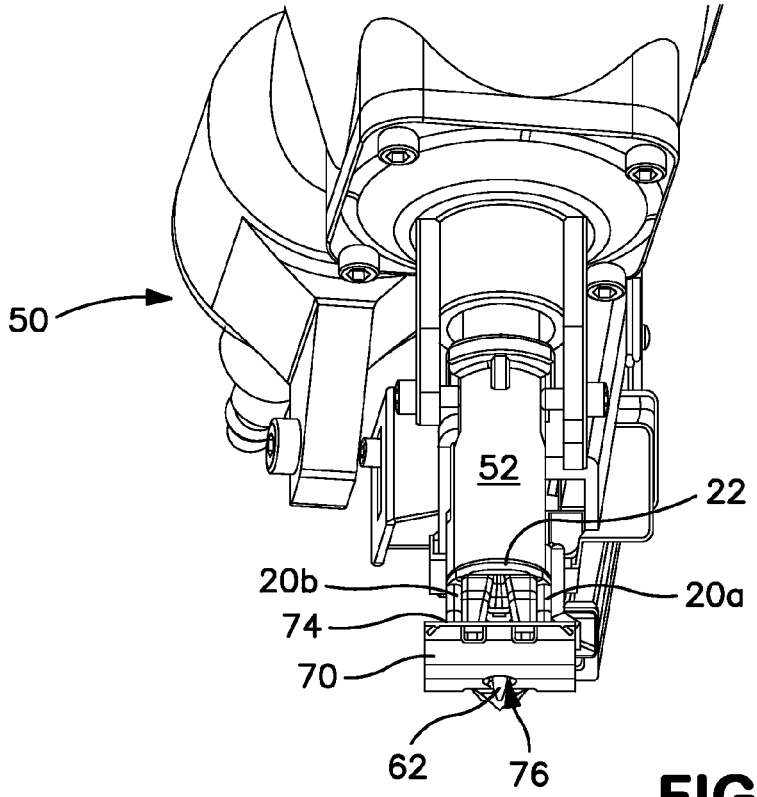
FIG. 8B is a front view of the combination depicted in FIG. 8A.

With reference primarily to FIGS. 6 and 7, and as discussed above, the adapter 10 is configured to attach to the barrel 52 with the upper surfaces 24 and 26 substantially mating at the surface of the distal end 58. The adapter 10 is held rigidly in place by a combination of forces generated by the magnetic element 14 attracting to the steel barrel 52 and mechanical forces between the frame 12 and barrel. The upper surfaces may be slightly offset from the barrel distal end surface due to the slight flexibility of the polymeric material, especially at the adapter arm 20. The adapter 10 is positioned with the left rear flange 30 and right rear flange 32 abutting a rear surface of the barrel from the rear. In this embodiment, the left rear flange 30 is sized to be received by an opening 64 between the magazine clip 60 and rear surface of the barrel. The left side flange 28 and right side flange 34 are configured to provide additional leverage for assistance in properly aligning the adapter 10 with the barrel 52, particularly the adapter bottom opening 36 and the barrel opening 53. Obviously other specific configurations can exist for use with tools having different shaped and sized barrels; the disclosed adapter 10 is not limited in size, shape, number or position of flanges.

As shown most clearly in FIG. 7, the adapter 10 is positioned on the barrel 52 with the arm segments 20*a* and 20*b* flanking and the bridge 22 extending above the alignment extensions 59. The alignment extensions 59 extending through the adapter front opening 38 further assists in both alignment and attachment of the adapter 10 to the barrel 52 by mechanical forces. This positioning is also advantageous as alignment extensions 59 are exposed for use during attachment of an installation clip, to be described in greater detail below. FIG. 7 depicts the adapter 10 attached to the nozzle 52 in a typical arrangement prior to engagement of an installation clip.

Attachment of the adapter 10 effectively converts the standard power driving tool 50 into a hands-free device without advanced tools or redesigning the tool or barrel. With the adapter 10 in place on the barrel 52 as shown, an installer can position the clip 70 in front of the adapter 10 with the alignment holes 72 generally in registry with the alignment extensions 59, whereupon attractive forces generated by the magnetic element 14 hold the metallic clip 70 in place against the lower surface 26, 27 of the adapter 10. An engaged clip 70 can abut the adapter rear ridges, 29 and 31. In a typical engagement of the adapter 10 and clip 70, the rear legs 25 of the clip will rest against the rear ridges, 29 and 31, thereby assisting alignment of the clip with the adapter and tool by preventing the clip from sliding rearward. The clip 70 is engaged with the adapter with the attachment hole 76 in position beneath the barrel bore 53 in position for driving a securing member 62 therethrough. The force of the securing member 62 driven from the bore overcomes the attractive forces of the magnetic element 14, and thereby disengages the clip 70 from the adapter as the fastener is attached to a support, such as a joist.

Figure 9:
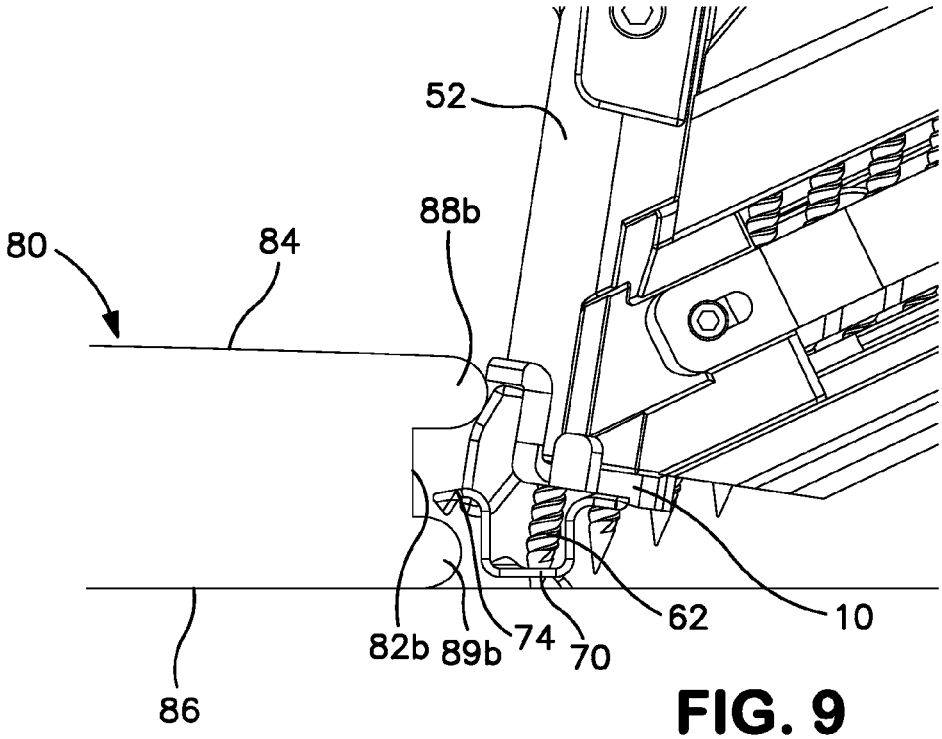
FIG. 9 depicts a typical installation of a decking plank using an installation clip driven from the clip/adapter/tool combination of FIG. 8B.
Figure 10:
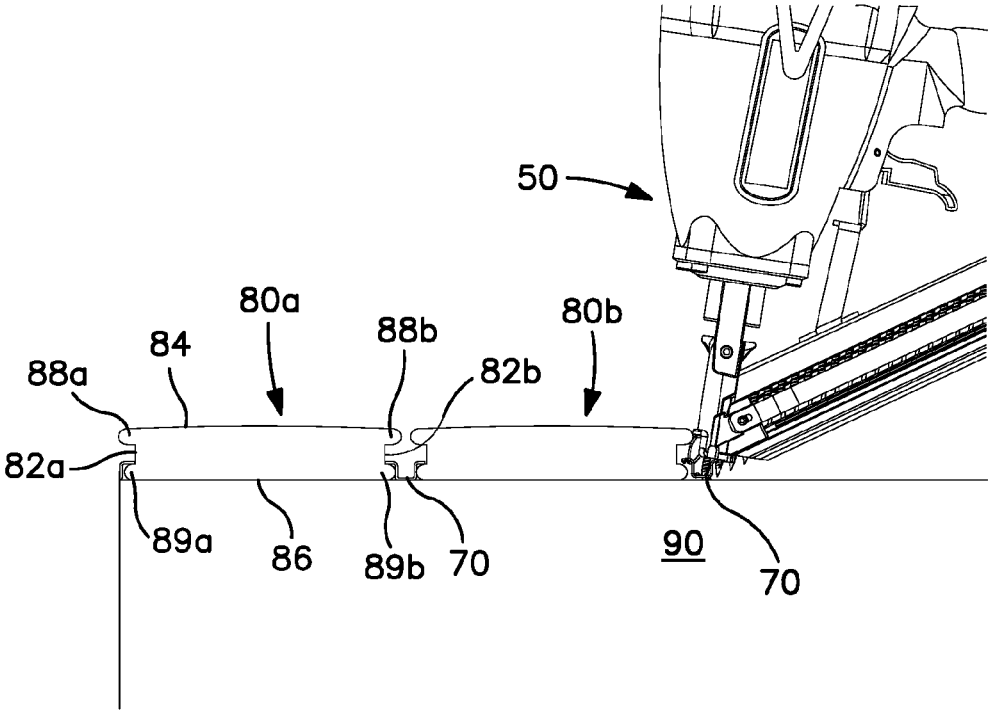
FIG. 10 depicts a typical assembly of a deck structure via the methods and instruments previously depicted.

FIGS. 9 and 10 depict assembly of a decking structure with a plurality of adjacent decking planks 80 with side-grooves 82 using a power tool with the disclosed adapter 10 attached for hands-free attachment of installation clips 70. A representative decking structure can be assembled substantially as described in copending U.S. patent application Ser. No. 13/030,625 and Ser. No. 13/532,145.

As shown, the elongated plank 80 has a top surface 84 and opposite bottom surface 86. The top and bottom surfaces can be generally flat or have slight curvatures. One preferred embodiment includes a slightly convex top surface 84 which assists in shedding fluid such as precipitation. As shown, the plank 80 also has opposite side grooves, 82*a* and 82*b*, extending at least a portion of the length thereof and dividing each edge into an upper nub, 88*a* and 88*b*, and lower nub, 89*a* and 89*b*. The upper nubs, 88*a* and 88*b*, preferably protrude further from the vertical bisection point of the plank 80 than the lower nubs, 89*a* and 89*b*, such that the lower surface 86 is narrower than the upper surface 84. These properties assist in concealing the installation clips 70 after installation as well as reducing moisture buildup within the respective side grooves, 82*a* and 82*b*.

Referring to FIGS. 9 and 10, the disclosed adapter 10 can be used to efficiently and safely attach a plurality of installation clips 70 with a corresponding plurality of elongated securing members 62 (nails, screws or like members) driven from the power tool 50 to fasten a series of planks 80 onto an array of supports 90. The supports 90 may be fixed in any number of conventional ways, such as by brackets, toe-nails, or the like to a backstop (i.e., a wall or array of posts). As described above, the adapter 10 is first positioned and attached to the barrel 52 of a power driving tool 50 by mechanical forces, attractive forces generated by the magnetic element 14, or a combination thereof. An installation clip 70 is thereafter attached in a driving position simply by an installer placing the clip 70 in front of the adapter 10 within range of the attractive forces generated by the magnetic element 14. The magnetic forces are strong enough to attach the clip 70 firmly against the adapter bottom surface 26, 27. The clip 70 is maintained in position with its attachment hole 76 substantially beneath the barrel bore 53 with the front-most elongated securing member 72 aligned for driving through the attachment hole 76.

During assembly of the decking structure, a lead plank 80*a* is positioned onto the upper surfaces of the supports 90 with one of its grooved edges positioned against the backstop (not shown), leaving the other grooved side exposed on the opposite side. A first plurality of installation clips 70 are then positioned with their leading wings 74 at least partially within the open side groove 88*b*, and each hidden fastener is attached to one of the supports 90 by an elongated securing member 62. FIG. 9 shows an enlarged view of an installation clip 70 engaged with the adapter 10 via magnetic forces from the magnetic element 14, being positioned within the side groove 82*b* prior to driving of the securing member 62. Driving the securing member 62 through the attachment opening into the support 90 disengages the installation clip 70 from the adapter 10, secures the installation clip to the support 90 and to the plank 80 via engagement of the leading wing 74 to the plank lower nub 82*b* (similar to the installation system disclosed in co-pending and co-owned U.S. patent application Ser. No. 12/573,540).

With further reference to FIG. 10, subsequent to attachment of the lead plank 80*a* onto the supports 90 with a first series of fasteners, a first trailing plank 80*b* is assembled onto the foot portion 75 of the attached first series of clips. A second series of fasteners are then assembled to the first trail plank open end and attached to the support surfaces, substantially as described above with respect to the hands-free attachment of the first series of fasteners.

The disclosed adapter 10 can be sized and shaped as appropriate to fit a variety of commercially available power driving tools. The adapter 10 can attach thereto by mechanical forces, magnetic forces, or a combination thereof, to allow a safe and efficient hands-free attachment of a decking installation clip by attractive magnetic forces.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

The invention claimed is:

1. An adapter for use with a power tool having a nozzle defining a bore from which an elongated securing member can be driven, comprising:

a first surface comprising a right portion spaced from a left portion defining an attachment opening therebetween, the first surface configured to abut a distal portion of the nozzle when the adapter and nozzle are attached at least partially by mechanical forces;

an arm that extends between the right portion and left portion;

a second surface configured to abut a portion of an installation clip when engaged therewith;

at least one flange extending in the direction opposite the second surface and configured to align the adapter with the nozzle;

a magnetic element positioned and configured to magnetically attract an installation clip toward the second surface, wherein the arm maintains the left portion and right portion on opposite sides of the bore when the adapter is attached to the nozzle in an attachment position, the adapter is shaped and configured such that to hold the installation clip in position with an attachment opening of the clip in registration with the bore when the adapter is in the attachment position and the clip is engaged with the adapter at least partially by the attraction of the magnetic element.

2. The adapter of claim 1, wherein the magnetic element attracts the first surface of the adapter to the nozzle, thereby assisting in attachment thereto.

3. The adapter of claim 1, wherein the first surface generally defines a first plane and the arm extends generally perpendicular to the first plane in a first direction.

4. The adapter of claim 1, comprising at least one flange extending from the first surface in the first direction positioned to extend into a notch in the nozzle to assist rigid attachment of the adapter to the nozzle.

5. The adapter of claim 1, comprising at least one flange extending from the first surface in the first direction configured to abut a surface of the nozzle, thereby laterally aligning the adapter with the nozzle when attached.

6. An adapter for use with a power tool having a nozzle, comprising:

a frame having a contour configured to generally mate with a portion of the nozzle for substantially rigid attachment thereto with a first surface of the frame in abutment with the nozzle, the first surface being split between a left portion spaced from a right portion defining an attachment opening therebetween;

an arm that extends between the right portion and left portion; and a magnetic element positioned and configured to generate magnetic forces to assist in substantially rigid attachment of the adapter to the nozzle and assist in engagement of an installation clip with the adapter, wherein the nozzle defines a bore for driving an elongated securing member, and the arm maintains the left portion and right portion on opposite sides of the bore in abutment with the nozzle when the adapter is attached to the nozzle.

7. The adapter of claim 6, wherein the installation clip defines an attachment opening, configured such that when the adapter is engaged with the clip while attached to the nozzle, the clip is positioned with the attachment opening substantially in registration with the bore.

8. The adapter of claim 6, wherein the installation clip defines an attachment opening, configured to align the clip for driving of an elongated securing member from the bore through the attachment opening when the adapter is attached to the nozzle and engaged with the clip.

9. The adapter of claim 6, wherein the frame is shaped to assist in attachment of the adapter to the nozzle by mechanical forces.

10. The adapter of claim 6, wherein the bore extends from a proximal end to a distal end and the frame includes at least one flange extending toward the proximal end when attached positioned to abut an outer surface of the nozzle, thereby aligning the adapter and nozzle.

11. The adapter of claim 6, wherein the installation clip defines an attachment opening, configured to align the clip, when engaged thereto, in a position that allows an elongated securing member to be driven from the bore through the attachment opening.

12. The adapter of claim 6, wherein the frame defines a lower surface and a rear ridge extending substantially perpendicular from the lower surface, the lower surface and rear ridge configured to abut an installation clip when engaged with the adapter, the rear ridge providing a rear barrier to assist in alignment of the clip with the adapter and power tool.

13. The adapter of claim 6, wherein the arm has a contour generally configured to correspond with an outer front contour of the nozzle and assist in mechanically attaching the adapter to the nozzle.

* * * * *